United States Patent [19]

Mitchell et al.

[11] 4,296,872

[45] Oct. 27, 1981

[54] DELIVERY BOX ASSEMBLY FOR MERCHANDISING MACHINE

[75] Inventors: Robert P. Mitchell, Pequannock; Frank T. Scalera, Maplewood, both of N.J.

[73] Assignee: Rowe International, Inc., Whippany, N.J.

[21] Appl. No.: 77,611

[22] Filed: Sep. 21, 1979

[51] Int. Cl.[3] ..... G07F 11/00

[52] U.S. Cl. ..... 221/195; 49/101; 49/114; 312/291

[58] Field of Search ..... 221/12, 75, 129, 193–196; 312/291; 109/68; 232/43.1; 49/68, 94, 101, 114

[56] References Cited

U.S. PATENT DOCUMENTS 4,094,440 6/1978 Lotspeich ..... 221/12

*Primary Examiner*—F. J. Bartuska

*Attorney, Agent, or Firm*—Shenier & O'Connor

[57] ABSTRACT

An improved delivery box assembly for a merchandising machine in which a door biased by gravity to a position at which it closes the delivery box opening is adapted to be pushed inwardly to rotate a pair of cranks carrying pins which ride in slots formed in crank arms carried by baffle pivots to rotate the baffle to a position at which it prevents access to the merchandise storage units of the machine before the door has been opened to an appreciable degree. An anti-jam flap prevents an article which is delivered while the door is open from falling into a pocket formed by the pivoted baffle and a stationary baffle thus to prevent jamming of the mechanism as the parts return to their initial position.

11 Claims, 6 Drawing Figures

Fig 1
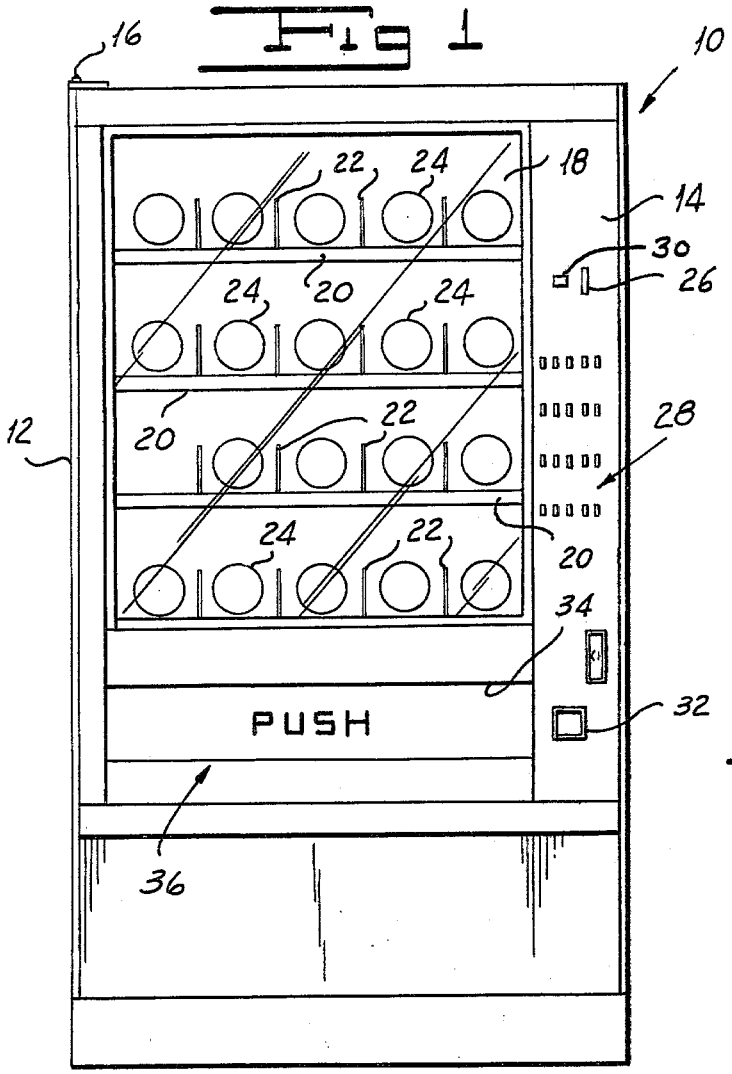
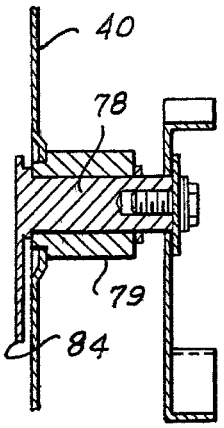
Fig 5
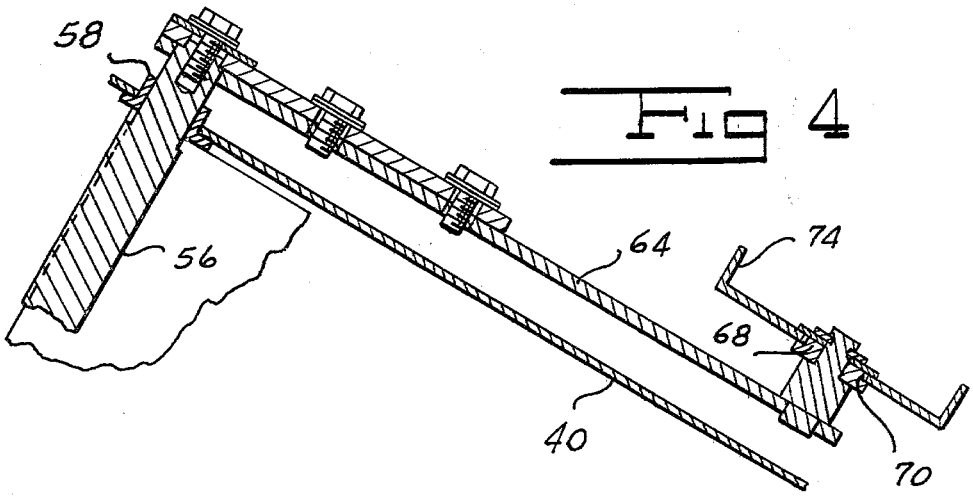
Fig 4

DELIVERY BOX ASSEMBLY FOR MERCHANDISING MACHINE

BACKGROUND OF THE INVENTION

In many merchandising machines known in the prior art an article which has been dispensed by one of a plurality of dispensing units in response, for example, to the deposit of money in the machine and to the actuation of a selecting mechanism drops into a delivery box located behind an opening in the machine cabinet. This access opening normally is closed by the delivery box door, which is adapted to be opened in some instances by pushing on the door actuator to gain access to the interior of the box. It also has been suggested in the prior art that means responsive to opening of the door be provided for preventing access to the merchandise carrying units of the machine by, for example, the insertion of a wire through the access opening and around the door to the merchandise carrying unit which usually are located above the door. In general, these mechanisms for preventing access to the merchandise carrying units are complicated and expensive. In many merchandising machines, the door is not locked during the inactive condition of the machine and can be held open and the machine can be operated with the door open. The danger exits that the mechanism may become jammed if an article is delivered by a dispensing unit while the door is thus held open.

SUMMARY OF THE INVENTION

One object of our invention is to provide an improved delivery box assembly for a merchandising machine which prevents access to the merchandise carrying units of the machine when the delivery box door is open.

Another object of our invention is to provide an improved delivery box assembly for a merchandising machine which is simpler in construction and operation than are delivery box assemblies of the prior art.

A still further object of our invention is to provide an improved delivery box assembly for a merchandising machine having means for preventing jamming of the assembly in the event that an article is delivered to the box while the door is held open.

Other and further objects of our invention will appear from the following description.

In general, our invention contemplates the provision of an improved delivery box assembly for a merchandising machine in which a door biased by gravity to a position at which it closes the delivery box opening is adapted to be pushed inwardly to rotate a pair of cranks carrying pins which ride in slots formed in crank arms carried by a baffle shaft to rotate the baffle to a position at which it prevents access to the merchandise storage units of the machine before the door has been opened to an appreciable degree. In the operative position of the baffle of our assembly, a tail portion thereof cooperates with a stationary baffle in a rearward extension of the box which is formed to accommodate an extension on the door. An anti-jam flap prevents an article which is delivered while the door is held open from moving into the pocket formed by the tail and the stationary baffle, thus to prevent the mechanism from becoming jammed when it returns to its initial condition.

BRIEF DESCRIPTION OF THE DRAWINGS

In the accompanying drawings to which reference is made in the instant specification and which form a part thereof and in which like reference numerals are used to indicate like parts in various views:

FIG. 1 is a front elevation of a merchandising machine provided with our improved delivery box assembly.

FIG. 4 is a fragmentary sectional view of our delivery box assembly for a merchandising machine taken along the line 4—4 of FIG. 3.

FIG. 5 is a fragmentary sectional view of our improved delivery box assembly for a merchandising machine taken along the line 5—5 of FIG. 3.

DESCRIPTION OF THE PREFERRED EMBODIMENT

Figure 2:
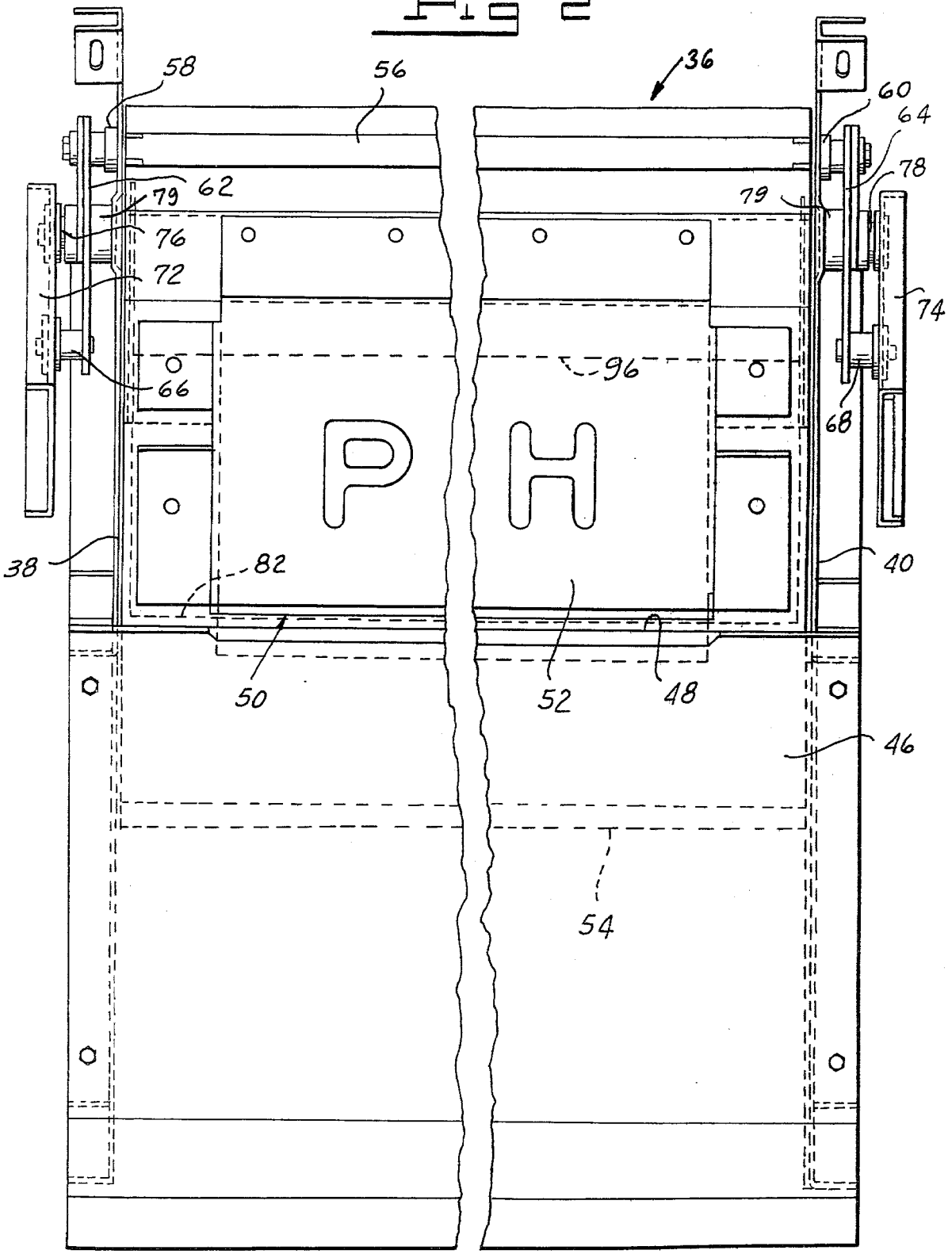
FIG. 2 is a front elevation of our improved delivery box assembly for a merchandising machine.

Referring now to FIG. 1 of the drawings, a merchandising machine indicated generally by the reference character 10 with which our improved delivery box assembly may be employed includes a cabinet 12 having a door 14 supported on the cabinet by means of a hinge 16. A window 18 in the door 14 permits a prospective customer to view the article next to be dispensed by the various delivery units of the machine. The machine 10 may, for example, include a plurality of superposed shelves 20, each of which carries a number of spaced partitions 22. Associated with the space between each pair of partitions is a delivery unit which may, for example, include a helical delivery member 24 adapted to be operated to deliver an article of merchandise over the front edge of its associated shelf 20. A coin slot 26, or the like, permits the introduction of coins into the machine to enable a selection to be made by operation of one or more buttons of an array 28 of pushbuttons. A coin return button 30 may be operated to cause deposited coins to be returned to the customer through an opening 32 before selection has been made. When, in a manner known to the art, sufficient money has been deposited in the slot 26 to enable a selection to be made and the buttons of the array 28 are actuated to make a selection, one of the members 24 is driven to move an article over the front edge of its shelf 20, so as to be received by our improved delivery box assembly indicated generally by the reference character 36, which is positioned behind an access opening 34 in the door 14.

Figure 3:
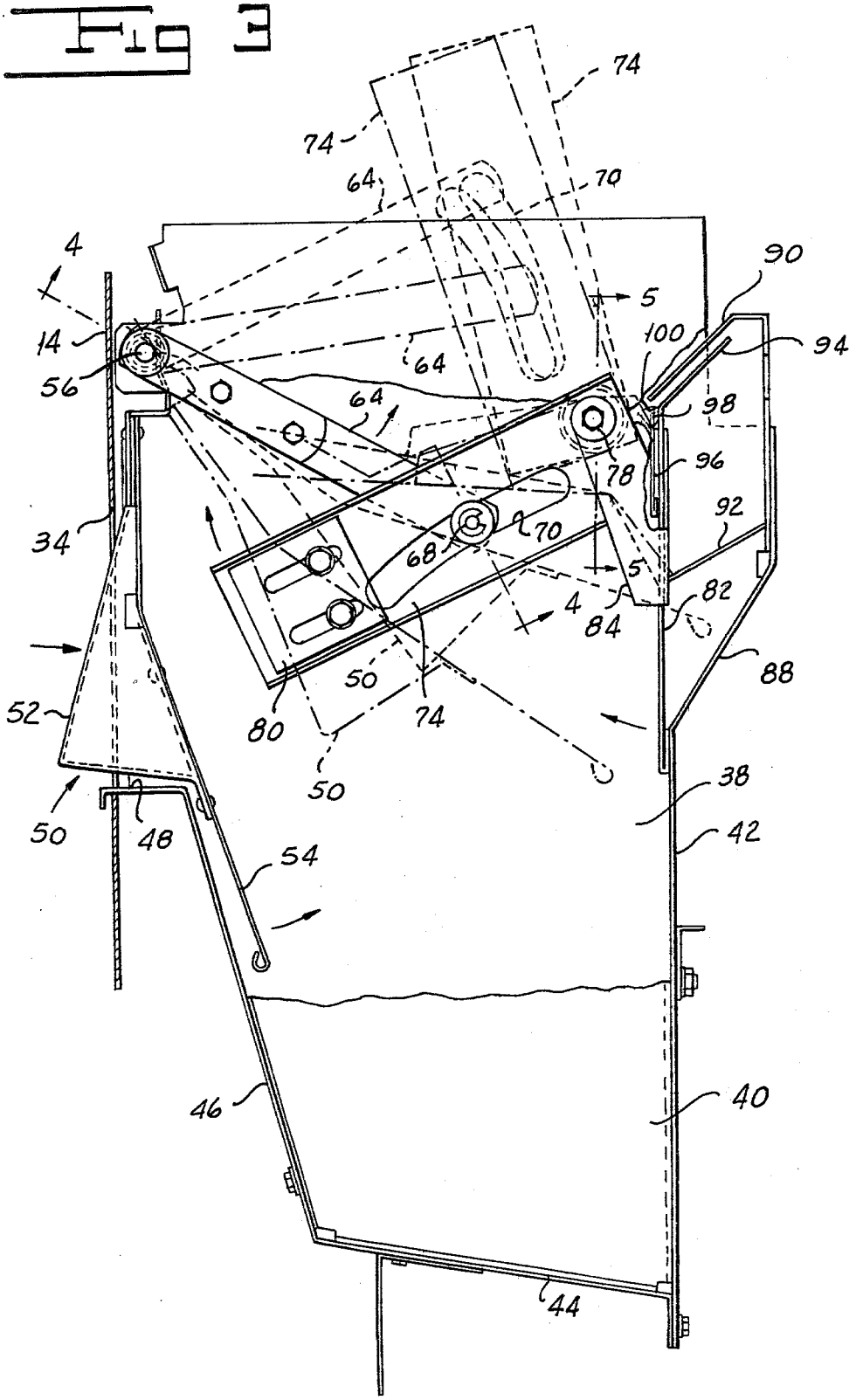
FIG. 3 is a side elevation with parts broken away and with other parts shown in section of our improved delivery box assembly for a merchandising machine.
Figure 6:
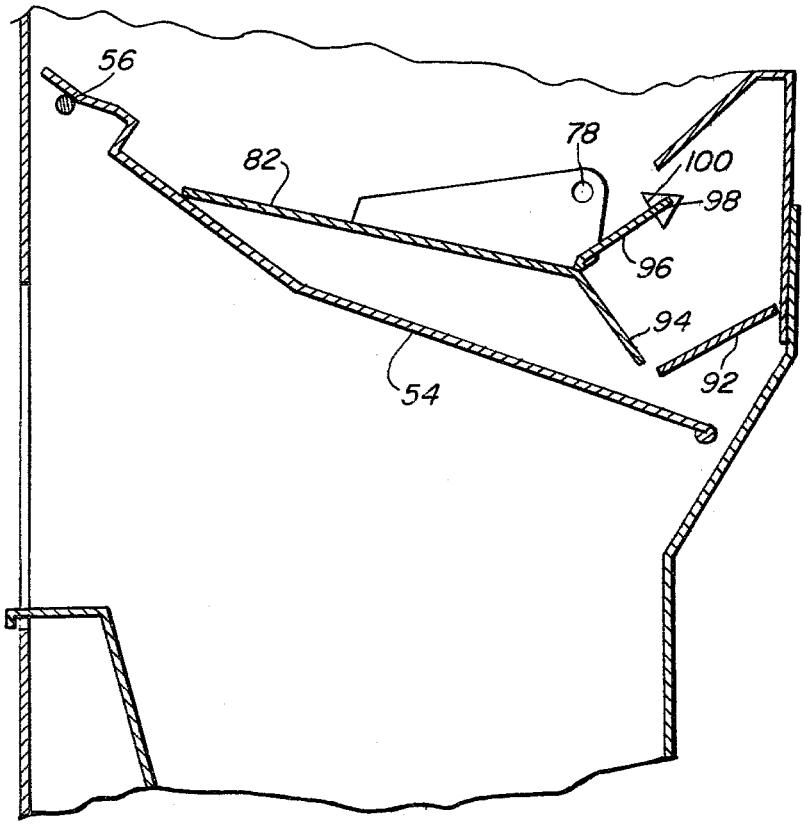
FIG. 6 is a side elevation of our improved delivery box assembly with the door shown in the fully open position.

Referring now to FIGS. 2 to 5 of the drawings, the delivery box assembly 36 includes a left side wall 38, a right side wall 40, a rear wall 42, a base 44, and a front wall 46, all of which parts are secured together in any suitable manner, such as by the use of screws, or the like, to form the box 36. In operation of the merchandising machine which the box 36 is used, articles delivered over the front edge of a shelf 20 by a delivery member 24 fall downwardly through the space between the window 18 and the front edges of the shelves 20 and through the open top of the box assembly 36, so as to come to rest on the base 44. Front wall 46 is formed with an access opening 48 which is normally closed by a door 50 provided with an outwardly protruding actuator 52. We mount the delivery box assembly 36 on the inside of the door 14 by any suitable means, such as mounting brackets, or the like, at a location at which the box assembly access opening 48 registers with the door access opening 34 through which the delivery box door actuator 52 extends. We provide the door 50 with a downwardly extending portion 54 which rests against the inner surface of the front wall 46 in the closed position of the door. Extension 54 must be sufficiently long to prevent dishonest persons from working a wire, or other such element, upwardly under the door and to the merchandise storage units.

We mount the door 50 on a shaft 56 by any suitable means, such as by welding or the like. Respective bushings 58 and 60 in the side walls 38 and 40 rotatably support the shaft 56. Shaft 56 also carries for rotation therewith respective right-hand and left-hand cranks 62 and 64. The ends of the cranks 62 and 64 remote from the shaft 56 carry pins 66 and 68. Each of the pins 66 and 68 rides in a slot 70, one of which is formed in a left-hand baffle operating crank arm 72 and the other slot of which is formed in the right-hand baffle operating crank arm 74. We mount the respective arms 72 and 74 on shafts 76 and 78 rotatably supported in bushings 79 in the respective side walls 38 and 40. We adjustably mount a weight 80 on the each of each of the arms 74 remote from the respective shafts 76 and 78 to control the force with which the assembly is biased by gravity to the relative position of the parts at which the door 50 closes the access opening 48.

Our assembly includes an anti-theft baffle 82 formed with a pair of ears 84 by means of which the baffle is pivotally supported on the shafts 76 and 78.

As has been pointed out hereinabove, the extension 54 on the door 50 must be sufficiently long to prevent a dishonest person from working a wire upwardly into the merchandise storage space of the machine 10. In order to accommodate the required pivotal movement of the door 50 having the extension 54 to permit full access to the interior of the box assembly 36 to receive an article of merchandise, we form the back wall 42 with a rearwardly extending portion 88 providing a recess in the back wall for receiving the lower end portion of extension 54 when door 50 has moved to its fully open position. We provide the upper end of the extension 88 with a downwardly and inwardly extending wall portion 90. The baffle 82 has a rearwardly extending tail portion 94 which underlies the portion 90 in the rest position of the parts. We also provide the recess formed by the rearwardly extending portion 88 with a stationary baffle 92. It will be seen that baffle 82 extends below the lower edge of the recess in the cooperative position of the baffle.

Our assembly includes an anti-jamming flap 96 which may be formed with a pair of outwardly extending ears 98 received in respective triangular cut-outs 100 in the walls 38 and 40.

In operation of our improved delivery box assembly, a customer deposits a sum in coins in the slot 26 aggregating at least the purchase price of a desired article. Next, he operates that button of the array 28 corresponding to the designation of the desired article. When that has been done, one of the members 24 moves an article over the front edge of its associated shelf 20. The thus selected article then falls downwardly through the space between the front edges of the shelves 20 and the window 18 until it comes to rest on the bottom 44 of the box assembly 36. Next, the customer pushes the actuator 52 to swing a door 50 in a counterclockwise direction as viewed in FIG. 3. As this is done, the main baffle 82 swings in a clockwise direction as viewed in FIG. 3 under the inter action between the pins 66 and 68 and the slots 70. We have illustrated an intermediate position of the parts in dot-dash lines in FIG. 3. From this showing, it will readily be apparent that the construction is such that the baffle 82 has very nearly reached its final blocking position when the door 50 has only been partially opened. As the door is moved to its fully open position as indicated by the broken line showing of FIG. 3, baffle 82 moves to its broken line position, in which position the tail 94 forms a pocket with the stationary baffle 92. In this position of the parts, however, the flap 96 moves to a position at which it covers the pocket. After the customer has withdrawn the article, the parts are restored to their full line positions under the action of the weights 80.

The arrangement of baffles just described prevents a dishonest person from working a wire or the like upwardly into the merchandise storage space, while holding the door open. In addition, our arrangement performs another function. That is, we have discovered that in the absence of the flap 96, if a person were to hold the door open and operate the machine in its normal manner an article such, for example, as a roll of mints, or the like, might fall into the pocket formed by the tail 94 and the stationary baffle 92 to result in a jamming of the parts as they attempted to return to their initial position. Our flap 96 prevents this result by ensuring that an article dispensed while the parts are held in the open position of the door drops to the bottom 44 of the box assembly when the door is released.

It will be seen that we have accomplished the objects of our invention. We have provided a delivery box assembly which prevents access to the merchandise storage space of the machine when the delivery box door is open. Our mechanism is extremely simple for the result achieved thereby. It also prevents accidental jamming of the parts by delivery of an article when the parts are held in the position corresponding to the open position of the door.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

We claim:

1. A delivery box assembly for receiving an article of merchandise from a dispensing unit and for holding the article at a location at which it is accessible to a customer including in combination, a box having a front wall, side walls, a bottom wall and an open top through which an article from said dispensing unit may fall to said bottom wall, said front wall formed with an opening permitting access to the interior of said box, a door, means mounting said door at the upper end thereof for pivotal movement inwardly of said box from a closed position over said front wall opening to an open position at which the interior of said box is accessible, a generally downwardly directed extension along the lower edge of said door, a recess formed in said back wall for accommodating said extension in the open position of said door, an inwardly directed stationary baffle in said recess, a second baffle, means mounting said second baffle for pivotal movement around an axis adjacent to the top of said box and intermediate said front and back walls between an inoperative position and an operative position in which it cooperates with said stationary baffle substantially to close said open top, means responsive to movement of said door from said closed position to said open position for moving said pivoted baffle to its operative position, a portion of said pivoted baffle and said stationary baffle forming a pocket in the operative position of said pivoted baffle, a flap, means mounting said flap for movement between an inoperative position and an operative position over said pocket to prevent an article from entering said pocket, and means responsive to movement of said pivoted baffle to its operative position for moving said flap to its operative position.

2. A delivery box assembly for receiving an article of merchandise from a dispensing unit and for holding the article at a location at which it is accessible to a customer including in combination, a box having a front wall, side walls, a bottom wall and an open top through which an article from said dispensing unit may fall to said bottom wall, said front wall formed with an opening permitting access to the interior of said box, a door, means mounting said door at the upper end thereof for pivotal movement inwardly of said box from a closed position over said front wall opening to an open position at which the interior of said box is accessible, a generally downwardly directed extension along the lower edge of said door, a recess formed in said back wall for accommodating said extension in the open position of said door, an inwardly directed stationary baffle in said recess, a second baffle, means mounting said second baffle for pivotal movement around an axis adjacent to the top of said box and intermediate said front and back walls between an inoperative position and an operative position in which it cooperates with said stationary baffle substantially to close said open top, means responsive to movement of said door from said closed position to said open position for moving said pivoted baffle to its operative position, a portion of said pivoted baffle and said stationary baffle forming a pocket in the operative position of said pivoted baffle, and means for preventing an article from entering said pocket.

3. A delivery box assembly for receiving an article of merchandise from an article dispensing unit and for holding said article at a location at which it is accessible to a customer including in combination, a box having a first opening through which said box can receive an article from said dispensing unit and having a second opening through which an article can be removed by a customer, a door, first shaft means mounting said door adjacent to said second opening for movement between an open position and a closed position, a first stationary baffle in said box, a second baffle, second shaft means mounting said second baffle for movement between an inoperative position and an operative position at which it cooperates with said first baffle effectively to block said first opening, respective left-hand and right-hand first cranks carried by said door mounting shaft means for movement therewith, respective left-hand and right-hand second cranks carried by said baffle shaft means for movement therewith, pins carried respectively by one of each of said first and second cranks, the other of each of said first and second cranks being formed with a slot for receiving one of said pins to provide connections between said first levers and said second levers respectively, said connections being such that said first baffle moves to its operative position in response to movement of said door to its open position, said fixed baffle and said second baffle in its operative position forming a pocket adjacent to said first opening and means for preventing an article delivered to said box by said dispensing means with movable baffle in its operative position from entering said pocket.

4. A delivery box assembly for receiving an article of merchandise from an article dispensing unit for holding said article at a location at which it is accessible to a customer including in combination, a box having a first opening through which said box can receive an article from said dispensing unit and having a second opening through which an article can be removed by a customer, a door, first shaft means mounting said door adjacent to said second opening for movement between an open position and a closed position, a first stationary baffle in said box, a second baffle, second shaft means mounting said second baffle for movement between an inoperative position and an operative position at which it cooperates with said first baffle effectively to block said first opening, respective left-hand and right-hand first cranks carried by said door mounting shaft for movement therewith, respective left-hand and right-hand second cranks carried by said baffle shaft means for movement therewith, pins carried respectively by one of each of said first and second cranks, the other of each of said first and second cranks being formed with a slot for receiving one of said pins to provide connections between said first cranks and said second cranks, said pin and slot connections being such that said first baffle moves to its operative position in response to movement of said door to its open position, said fixed baffle and said second baffle in its operative position forming a pocket adjacent to said first opening, a flap, means mounting said flap for movement from an inoperative position at which it closes said pocket and means responsive to movement of said movable baffle to its operative position for moving said flap to its operative position.

5. A delivery box assembly for receiving an article of merchandise from a dispensing unit and for holding the article at a location at which it is accessible to a customer including in combination, a box having a first opening through which said box is to receive an article from said dispensing unit and having a second opening through which said article may be removed by a customer, a door, first shaft means mounting said door adjacent to said second opening for movement between an open position and a closed position, a baffle, second shaft means mounting said baffle for movement between an inoperative position and an operative position at which it effectively blocks said first opening, respective left-hand and right-hand first cranks on said door mounting shaft means for movement therewith, respective left-hand and right-hand second cranks on said baffle shaft means for movement therewith, pins carried respectively by one of each of said first and second cranks, the other of each of said first and second cranks being formed with a slot for receiving one of said pins to provide connections between said first and second cranks, said pin and slot connections being such that said baffle moves to its operative position in response to movement of said door to its open position.

6. A delivery box assembly for receiving an article of merchandise from an article dispensing unit and for holding the article at a location at which it is accessible to a customer including in combination, a box having a first opening through which said box is adapted to receive an article from said dispensing unit and having a second opening through which said article may be removed by a customer, a door, a shaft mounting said door adjacent to said second opening for movement between an open position and a closed position over said second opening, a baffle, a pivot shaft mounting said baffle adjacent to said first opening between an inoperative position and an operative position at which it substantially blocks said first opening, a first crank on said door mounting shaft, a second crank on said baffle pivot shaft, a pin in one of said cranks, a slot in the other of said cranks for receiving said pin to provide a connection between said cranks, said pin and slot connection being so constructed that said baffle moves from said inoperative position to said operative position in response to movement of said door to said open position, a stationary baffle, a portion of said pivoted baffle in its operative position forming a pocket with said stationary baffle adjacent to said first opening, a flap, means mounting said flap for pivotal movement between an inoperative position and an operative position at which it covers said pocket and means responsive to movement of said baffle to its operative position for moving said flap to its operative position.

7. A delivery box assembly for receiving an article of merchandise from an article dispensing unit and for holding the article at a location at which it is accessible to a customer including in combination, a box having a first opening through which said box is adapted to receive an article from said dispensing unit and having a second opening through which said article may be removed by a customer, a door, a shaft mounting said door adjacent to said second opening for movement between an open position and a closed position over said second opening, a baffle, a pivot shaft mounting said baffle adjacent to said first opening between an inoperative position and an operative position at which it substantially blocks said first opening, a first crank on said door mounting shaft, a second crank on said baffle pivot shaft, a pin on one of said cranks, a slot in the other of said cranks for receiving said pin to provide a connection between said cranks, said pin and slot connection being so constructed that said baffle moves from said inoperative position to said operative position in response to movement of said door to said open position, a stationary baffle, a portion of said pivoted baffle in its operative position forming a pocket with said stationary baffle adjacent to said first opening, and means for preventing an article from said article delivery means from entering said pocket.

8. A delivery box assembly for receiving an article of merchandise from an article dispensing unit and for holding the article at a location at which it is accessible to a customer including in combination, a box having a first opening through which said box is adapted to receive an article from said dispensing unit and having a second opening through which said article may be removed by a customer, a door, a shaft mounting said door adjacent to said second opening for movement between an open position and a closed position over said second opening, a baffle, a pivot shaft mounting said baffle adjacent to said first opening between an inoperative position and an operative position at which it substantially blocks said first opening, a first crank on said door mounting shaft, a second crank on said baffle pivot shaft, a pin on one of said cranks, and a slot in the other of said cranks for receiving said pin to provide a connection between said cranks, said pin and slot connection being so constructed that said baffle moves from said inoperative position to said operative position in response to movement of said door to said open position.

9. An assembly as in claim 8 including a weight on said second crank for biasing said baffle and said door respectively to their inoperative and closed positions.

10. An assembly as in claim 8 in which said pin and slot connection is so constructed that said baffle approaches its operative position while said door is between its open and closed positions.

11. A delivery box assembly for receiving articles of merchandise from an article dispensing unit and for holding the article at a location at which it is accessible to a customer including in combination a box having a back, sides, a bottom, a front formed with an access opening and an open top through which an article of merchandise can drop for delivery to a customer, a door, a shaft mounting said door adjacent to said access opening for pivotal movement between an open position and a closed position over said access opening, a baffle, a pivot shaft mounting said baffle for pivotal movement between an inoperative position and an operative position at which it closes the open top of said box a first crank on said door mounting shaft, a second crank on said baffle mounting shaft, a pin on one of said cranks, a slot in the other of said cranks for receiving said pin to connect said cranks, said pin and slot connection being so constructed as to move said baffle from said inoperative position to said operative position in response to movement of said door from said closed position to said open position.

* * * * *